US011407234B2

(12) United States Patent
Akiyama

(10) Patent No.: US 11,407,234 B2
(45) Date of Patent: Aug. 9, 2022

(54) PRINTER

(71) Applicant: Ricoh Company, Ltd., Tokyo (JP)

(72) Inventor: Yoshitaka Akiyama, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 87 days.

(21) Appl. No.: 17/027,915

(22) Filed: Sep. 22, 2020

(65) Prior Publication Data

US 2021/0155015 A1 May 27, 2021

(30) Foreign Application Priority Data

Nov. 26, 2019 (JP) ..... JP2019-213248

(51) Int. Cl.
*B41J 11/00* (2006.01)
*B41J 29/377* (2006.01)

(52) U.S. Cl.
CPC ..... *B41J 11/0015* (2013.01); *B41J 29/377* (2013.01)

(58) Field of Classification Search
CPC ..... B41J 11/0015; B41J 29/377
See application file for complete search history.

(56) References Cited

FOREIGN PATENT DOCUMENTS

| | | | |
|---|---|---|---|
| JP | 3832896 B2 * | 10/2006 | ..... B41J 2/14024 |
| JP | 2012-091387 | 5/2012 | |
| JP | 2018-020576 | 2/2018 | |

* cited by examiner

*Primary Examiner* — Justin Seo
(74) *Attorney, Agent, or Firm* — Xsensus LLP

(57) ABSTRACT

A printer includes a treatment liquid applier configured to apply a treatment liquid onto a sheet, a printing device configured to print on the sheet onto which the treatment liquid has been applied, a heater configured to heat the treatment liquid in the treatment liquid applier, and circuitry configured to control the heater according to a printing condition to print on the sheet.

5 Claims, 13 Drawing Sheets

PRINTER

CROSS-REFERENCE TO RELATED APPLICATION

This patent application is based on and claims priority pursuant to 35 U.S.C. § 119(a) to Japanese Patent Application No. 2019-213248, filed on Nov. 26, 2019, in the Japan Patent Office, the entire disclosures of which is hereby incorporated by reference herein.

BACKGROUND

Technical Field

An aspect of the present disclosure relates to a printer.

Related Art

A printer prints an image on a sheet as an object to be printed after applying a treatment liquid to the sheet.

The printer heats a preprocessing agent to a temperature equal to or higher than a melting point and applies the preprocessing agent to a recording medium. The preprocessing agent contains a wax component that is solid at room temperature. Further, the printer changes a nip pressure of an application roller to increase an application amount of a treatment liquid on the recording medium when a print speed is increased.

SUMMARY

In an aspect of this disclosure, a printer includes a treatment liquid applier configured to apply a treatment liquid onto a sheet, a printing device configured to print on the sheet onto which the treatment liquid has been applied, a heater configured to heat the treatment liquid in the treatment liquid applier, and circuitry configured to control the heater according to a printing condition to print on the sheet.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
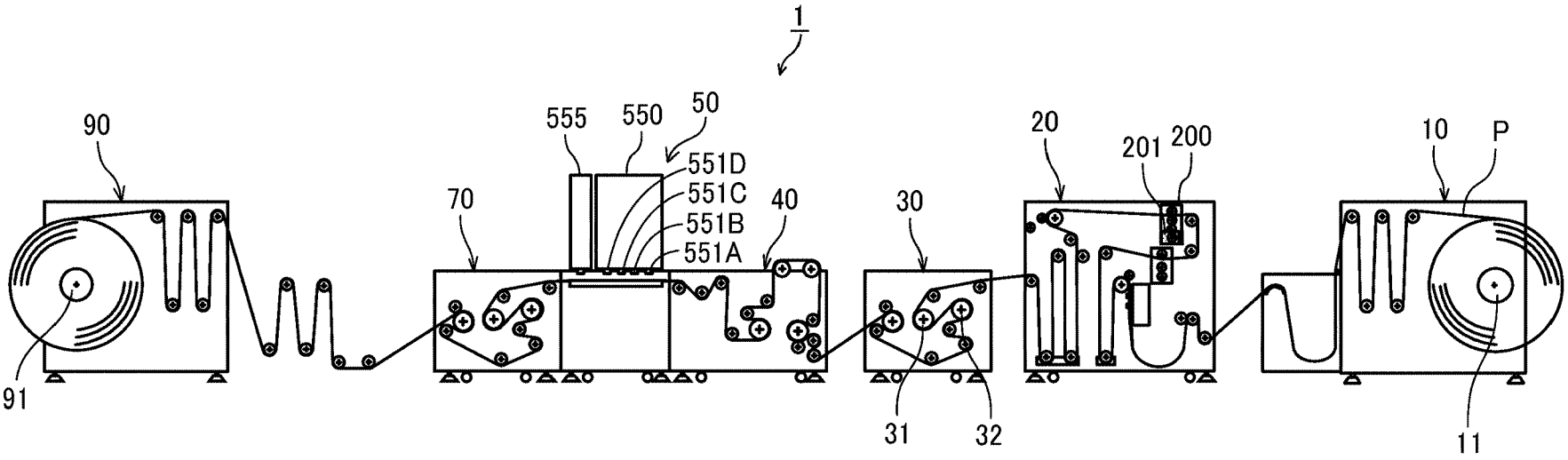
FIG. 1 is a schematic front view of a printer according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a," "an," and "the" are intended to include the plural forms as well, unless the context clearly indicates otherwise.

Figure 2:
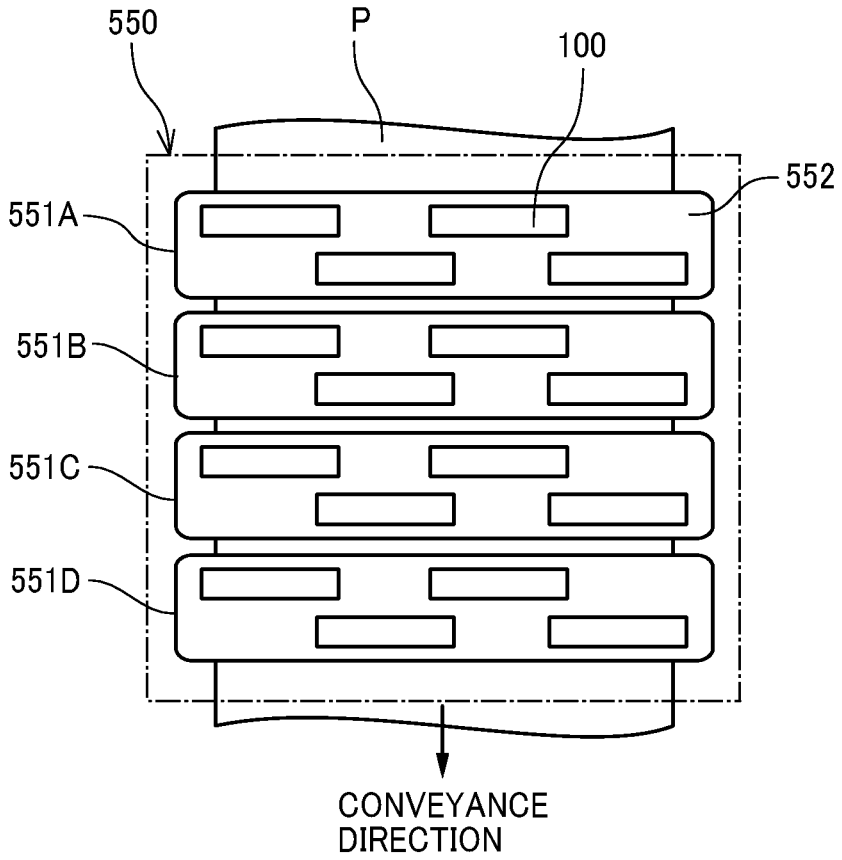
FIG. 2 is a plan view of a liquid discharge device of the printer.

Referring now to the drawings, wherein like reference numerals designate identical or corresponding parts throughout the several views, embodiments of the present disclosure are described below. First, a printer according to a first embodiment of the present disclosure is described with reference to FIGS. 1 and 2. FIG. 1 is a schematic front view of a printer as a liquid discharge apparatus according to a first embodiment of the present disclosure. FIG. 2 is a plan view of a liquid discharge device 550 of the printer 1.

The printer 1 includes a feeder 10, a preprocessing device 20, and a postprocessing drying device 30. The feeder 10 feeds the sheet P as a web. The preprocessing device 20 applies a treatment liquid onto the sheet P fed from the feeder 10. The postprocessing drying device 30 dries the treatment liquid 201 applied onto the sheet P. That is, the postprocessing drying device 30 dries the sheet P after the treatment liquid 201 is applied on the sheet P.

Further, the printer 1 includes a guide conveyor 40, a printing device 50, a dryer 70, and an ejector 90. The guide conveyor 40 guides and conveys the sheet P passing through the postprocessing drying device 30. The printing device 50 discharges a liquid containing a colorant onto the sheet P to form an image on the sheet P. The dryer 70 dries the sheet P onto which an image is formed by the printing device 50. The ejector ejects the sheet P after dried by the dryer 70.

A plain paper, a coated paper, or the like may be used as the sheet P. A surface modification treatment layer is formed on the surface of a substrate of the coated paper.

The sheet P is fed from a winding roller 11 of the feeder 10 and guided and conveyed by the rollers of the feeder 10, the preprocessing device 20, the postprocessing drying device 30, the guide conveyor 40, the dryer 70, and the ejector 90. Then, the sheet P is wound around a take-up roller 91 of the ejector 90.

The preprocessing device 20 includes a treatment liquid applier 200 to apply treatment liquid 201 onto the sheet P. Then, the postprocessing drying device 30 dries the treatment liquid 201 on the sheet P. Then, the sheet P is conveyed to the printing device 50.

Then, the sheet P is conveyed to face a liquid discharge device 550 and a treatment-liquid discharge device 555.

Then, the liquid discharge device 550 discharges a liquid onto the sheet P to form a desired image on the sheet P. Further, the treatment-liquid discharge device 555 discharges a treatment liquid onto the sheet P to perform postprocessing if necessary.

Here, the liquid discharge device 550 includes, for example, four color full-line head arrays 551A, 551B, 551C, and 551D from the upstream side in a conveyance direction of the sheet P. Hereinafter, the full-line head arrays 551A, 551B, 551C, and 551D are simply referred to as "head arrays 551" when colors are not distinguished. The conveyance direction is indicated by arrow in FIG. 2.

The head arrays 551 are liquid dischargers to discharge liquid of, for example, black (K), cyan (C), magenta (M), and yellow (Y) onto the sheet P conveyed. Note that number and types of color are not limited to the above-described four colors of K, C, M, and Y and may be any other suitable number and types.

In each head array 551, for example, as illustrated in FIG. 2, liquid discharge heads 100 are staggered on a base 552 to form the head array 551. Note that the configuration of the head array 551 is not limited to such a configuration. Hereinafter, the "liquid discharge head" is simply referred to as the "head."

Further, the printer 1 according to the first embodiment of the disclosure is described as a printer that discharges a liquid to perform printing. However, the printer 1 may use an electrophotographic process to perform printing. Although the sheet P is described as a continuous body such as a continuous paper or a roll paper, or a web, the sheet P may be a large-sized cut sheet such as a cut sheet or a wallpaper.

Figure 3:
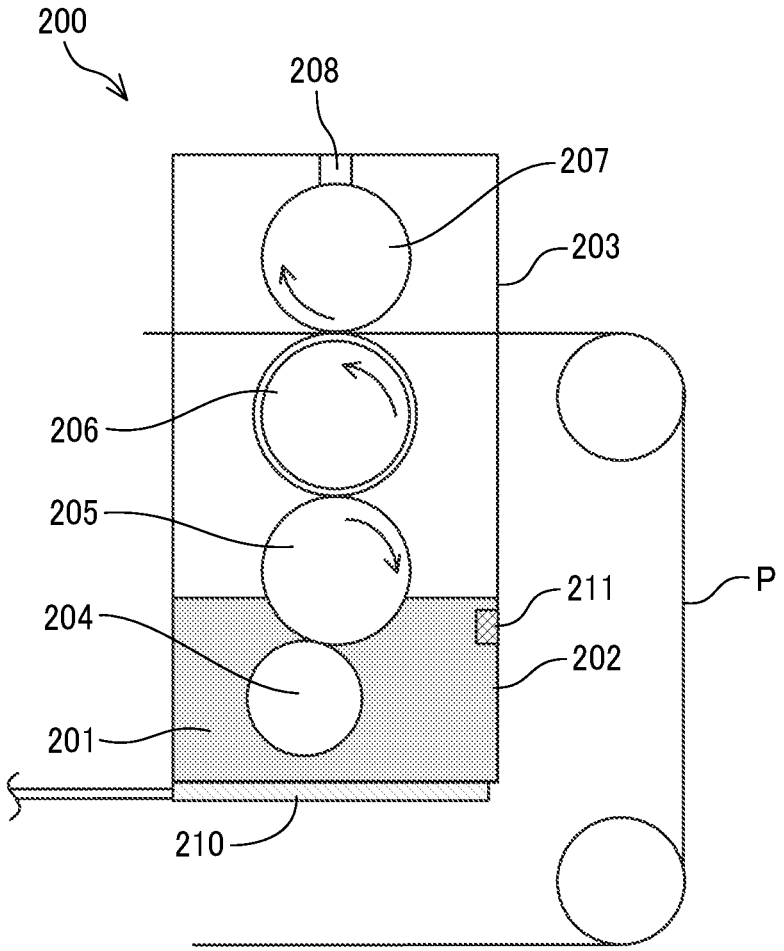
FIG. 3 is a schematic cross-sectional front view of a treatment liquid applier of the printer according to the first embodiment of the present disclosure.

Next, the treatment liquid applier 200 of the preprocessing device 20 according to the first embodiment of the present disclosure is described with reference to FIG. 3. FIG. 3 is a schematic cross-sectional front view of the treatment liquid applier 200 according to the first embodiment of the present disclosure.

The treatment liquid applier 200 of the preprocessing device 20 includes a treatment liquid container 202 to store the treatment liquid 201. The treatment liquid container 202 and a case 203 may form a single body. The case 203 serves as a housing of the treatment liquid applier 200.

The treatment liquid container 202 includes a stirring roller 204 to stir the treatment liquid 201. The treatment liquid applier 200 includes a transfer roller 205 and an application roller 206. The transfer roller 205 (scooping roller) is housed in the treatment liquid container 202 and scoops up the treatment liquid 201. The application roller 206 applies the treatment liquid 201 onto the sheet P.

Further, the treatment liquid container 202 includes a pressure roller 207 and a pressure adjusting device 208. The pressure roller 207 faces the application roller 206 and presses the sheet P against the application roller 206. The pressure adjusting device 208 adjusts a pressing pressure of the pressure roller 207 to press the sheet P against the application roller 206.

The treatment liquid applier 200, first, transfers the treatment liquid 201 in a thin-film form onto a surface of the application roller 206 by the stirring roller 204 and the transfer roller 205.

Then, the application roller 206 is pressed against a rotating pressure roller 207 that rotates the application roller 206. Then, the treatment liquid applier 200 conveys the sheet P into a gap between the application roller 206 and the pressure roller 207 to apply the treatment liquid 201 onto the surface of the sheet P.

The pressure adjusting device 208 controls the nip pressure at a time of applying the treatment liquid 201 to the sheet P. The nip pressure acts on a position at which the application roller 206 contacts the pressure roller 207.

The treatment liquid applier 200 uses the pressure adjusting device 208 to change the nip pressure between the application roller 206 and the pressure roller 207 to adjust the application amount of the treatment liquid 201. The application amount includes a coating amount, a film thickness, a liquid amount, an adhesion amount, a dry adhesion amount, and the like.

The treatment liquid applier 200 can changes a rotation speed of the application roller 206 and the pressure roller 207 to control the application amount of the treatment liquid 201.

The treatment liquid applier 200 includes a heater 210 and a temperature sensor 211. The heater 210 heats the treatment liquid 201 in the treatment liquid container 202 (treatment liquid applier 200). The temperature sensor 211 serves as a temperature detector to detect a temperature of the treatment liquid 201 in the treatment liquid container 202.

Next, the postprocessing drying device 30 that dries the sheet P after the treatment liquid 201 is applied to the sheet P is described with reference to FIG. 1.

The postprocessing drying device 30 includes heat rollers 31 and 32.

The sheet P to which the treatment liquid 201 is applied is fed to the heat rollers 31 and 32 by conveyance rollers. The heat rollers 31 and 32 are heated to a high temperature from 50° C. to 100° C. The heat rollers 31 and 32 contacts the sheet P and transfer the heat to the sheet P, to which the treatment liquid 201 is applied, so that water content in the treatment liquid 201 is evaporated and the sheet P is dried.

Figure 4:
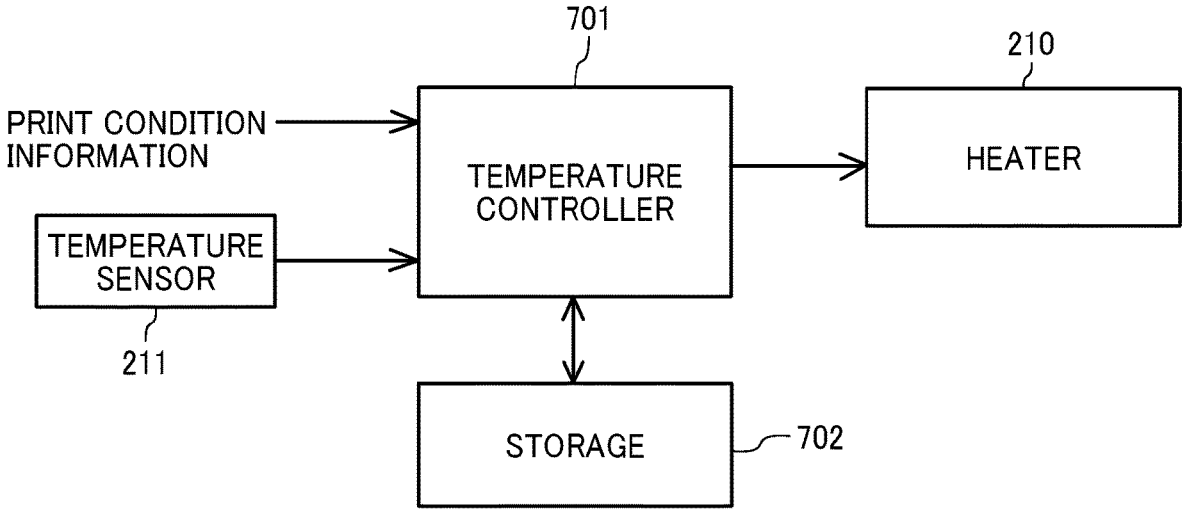
FIG. 4 is a block diagram of a temperature controller of the treatment liquid of the treatment liquid applier of the printer according to the first embodiment of the present disclosure.

Next, a part of the treatment liquid applier 200 related to control a temperature of the treatment liquid 201 is described with reference to a block diagram of FIG. 4.

A temperature controller 701 inputs print condition information regarding print conditions and a detected temperature detected by the temperature sensor 211 of the treatment liquid applier 200. The temperature controller 701 controls the heater 210 of the treatment liquid applier 200 to heat the treatment liquid 201 in the treatment liquid applier 200 (treatment liquid container 202) according to the printing conditions and the detected temperature. The temperature controller 701 serves as circuitry that is configured to control the heater 210 according to a printing condition to print on the sheet P.

The treatment liquid applier 200 includes a storage 702 that stores information such as a relation between the temperature of the treatment liquid and the printing conditions, for example, a print speed, resolution, and the type of the sheet P (medium type), or a relation among the type of the sheet P (medium type), the resolution for each print speed and the application amount of the treatment liquid 201, a relation between the viscosity and the application amount pf the treatment liquid 201, and the relation between the temperature and the viscosity of the treatment liquid 201.

The temperature controller 701 acquires temperature information corresponding to the printing conditions. The temperature controller 701 controls heating (turning ON and turning OFF) of the heater 210 so that the detected temperature becomes the acquired temperature.

Figure 5:
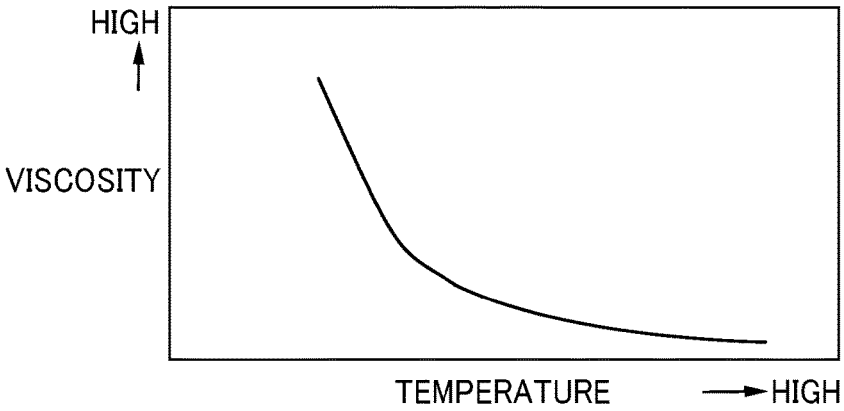
FIG. 5 is a graph illustrating a characteristic between a viscosity and a temperature of the treatment liquid used in the printer according to the first embodiment of the present disclosure.

Next, a characteristic between a viscosity and a temperature of the treatment liquid 201 used in the first embodiment according to the present disclosure is described with reference to FIG. 5. FIG. 5 is a graph illustrating the characteristic between the viscosity and the temperature of the treatment liquid 201.

The viscosity of the treatment liquid 201 increases with a decrease in the temperature of the treatment liquid 201 and decreases with an increase in the temperature of the treatment liquid 201.

With increase in the rotation speed of the application roller 206, the rotation speed of the transfer roller 205 also increases. Thus, a scooping amount of the treatment liquid 201 per unit time of the transfer roller 205 increases, and the application amount of the application roller 206 also increases.

Conversely, with a decrease in the rotation speed of the application roller 206, the rotation speed of the transfer roller 205 decreases. Thus, the scooping amount of the treatment liquid 201 per unit time of the transfer roller 205 decreases, and the application amount of the application roller 206 also decreases.

Further, with increase in the viscosity of the treatment liquid 201, the scooping amount of the treatment liquid 201 per unit time of the transfer roller 205 increases, and the application amount of the application roller 206 also increases.

Conversely, with decrease in the viscosity of the treatment liquid 201, the scooping amount of the treatment liquid 201 per unit time of the transfer roller 205 decreases, and the application amount of the application roller 206 also decreases.

Next, an outline of the control of the temperature of the treatment liquid 201 according to the print speed, the resolution, and the type of the sheet P as the printing conditions is described below.

The temperature controller 701 of the treatment liquid applier 200 controls the heater 210 to increase the temperature of the treatment liquid 201 to decrease the viscosity of the treatment liquid 201 when the print speed is increased for a high-speed printing. The temperature controller 701 increases the temperature of the heater 210 to a setting temperature to increase the temperature of the treatment liquid 201.

Thus, the treatment liquid applier 200 can prevent an increase in the scooping amount of the treatment liquid 201 followed by the transfer roller 205 and to prevent an increase in the application amount of the treatment liquid 201 applied onto the sheet P. The treatment liquid applier 200 can reduce the application amount of the treatment liquid 201 onto the sheet P. Thus, the printer 1 does not have to increase the drying strength of the postprocessing drying device 30 and can reduce wasteful power consumption of the postprocessing drying device 30. The printer 1 increase the drying strength of the postprocessing drying device 30 with increase in the application amount of the treatment liquid 201 and decrease the drying strength of the postprocessing drying device 30 with decrease in the application amount of the treatment liquid 201.

Conversely, the temperature controller 701 of the treatment liquid applier 200 controls the heater 210 to decrease the temperature of the treatment liquid 201 to increase the viscosity of the treatment liquid 201 when the print speed is decreased for a low-speed printing. The temperature controller 701 turns off the heater 210 or uses a cooling device as described below to decreases the temperature of the heater 210 to a setting temperature to decrease the temperature of the treatment liquid 201.

Thus, the treatment liquid applier 200 can prevent a decrease in the scooping amount of the treatment liquid 201 followed by a rotation of the transfer roller 205 and to prevent a decrease in the application amount of the treatment liquid 201 applied onto the sheet P.

The treatment liquid applier 200 controls a printing resolution such that the treatment liquid applier 200 reduce the application amount of the treatment liquid 201 when the printing resolution is high (when a dot size is small) since a liquid droplet adhered onto the sheet P is less likely to bleed. Thus, the temperature controller 701 of the treatment liquid applier 200 controls the heater 210 to increase the temperature of the treatment liquid 201 to decrease the viscosity of the treatment liquid 201.

Thus, the treatment liquid applier 200 can prevent an increase in the scooping amount of the treatment liquid 201 followed by the rotation of the transfer roller 205 and to prevent an increase in the application amount of the treatment liquid 201 applied onto the sheet P. Thus, the printer 1 can reduce the application mount of the treatment liquid 201 onto the sheet P. Thus, the printer 1 does not have to increase the drying strength of the postprocessing drying device 30 and can reduce wasteful power consumption of the postprocessing drying device 30.

Conversely, the treatment liquid applier 200 controls a printing resolution such that the treatment liquid applier 200 increases the application amount of the treatment liquid 201 when the printing resolution is small (when a dot size is large) since a liquid droplet adhered onto the sheet P is likely to bleed. Thus, the temperature controller 701 of the treatment liquid applier 200 controls the heater 210 to decrease the temperature of the treatment liquid 201 to increase the viscosity of the treatment liquid 201.

Regarding the type of the sheet P, when a plain paper is used as the sheet P, raw material fibers appear on a surface of the plain paper. Thus, the treatment liquid 201 is easily absorbed to the plain paper, and the amount of the treatment liquid 201 on the surface of the sheet P easily decreases. Thus, the temperature controller 701 of the treatment liquid applier 200 controls the heater 210 to decrease the temperature of the treatment liquid 201 to increase the viscosity of the treatment liquid 201 so that a predetermined amount of treatment liquid 201 exists on a surface of the sheet P.

Thus, the scooping amount of the treatment liquid 201 scooped up by the transfer roller 205 is increased, so that the treatment liquid applier 200 can secure an amount of the treatment liquid 201 existing on the surface of the sheet P.

Conversely, when a coated paper is used as the sheet P, the treatment liquid 201 is hardly absorbed in the coated paper. The coated paper has a coated layer processed on a surface of the coated paper. Thus, the treatment liquid applier 200 can reduce the application amount of the treatment liquid 201 to be applied on the surface of the sheet P. Thus, the temperature controller 701 of the treatment liquid applier 200 controls the heater 210 to increase the temperature of the treatment liquid 201 to decrease the viscosity of the treatment liquid 201.

Thus, the treatment liquid applier 200 can reduce a scooping amount of the treatment liquid 201 by the transfer roller 205 and prevent an increase in the application amount of the treatment liquid 201 on the sheet P. Thus, the printer 1 can reduce the application amount of the treatment liquid 201. Thus, the printer 1 does not have to increase the drying strength of the postprocessing drying device 30 and can reduce wasteful power consumption of the postprocessing drying device 30.

Figure 6:
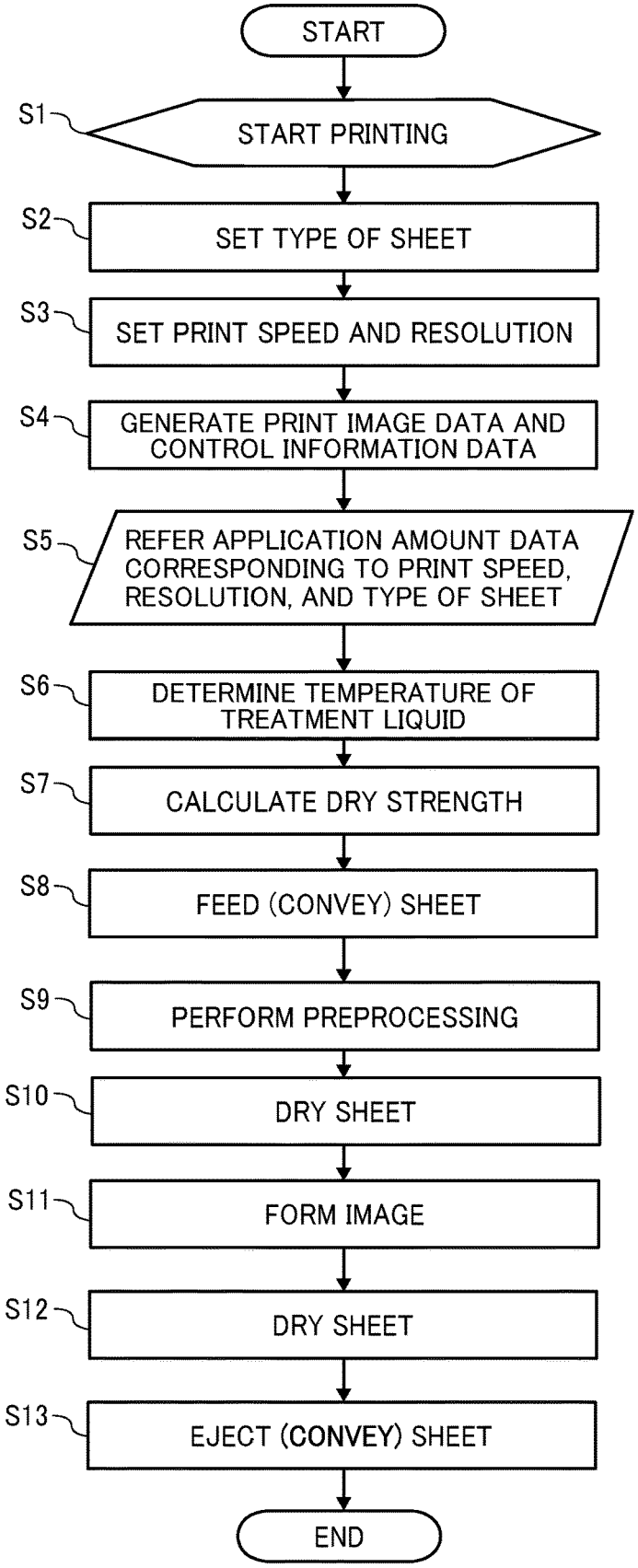
FIG. 6 is a flowchart illustrating control of a printing operation including the temperature control of the treatment liquid of the printer according to the first embodiment of the present disclosure.

FIG. 6 is a flowchart of control of the printing operation of the temperature control the treatment liquid in the printer 1 according to the first embodiment of the present disclosure.

When the printer 1 starts to form (print) an image on the sheet P (step S1), the printer 1 sets the type of sheet P (step S2) and sets the print speed and resolution (step S3). Hereinafter, the "step S1" is simply referred as "S1", and "the type of the sheet P" is simply referred to as a "medium type."

Then, the printer 1 generates print image data and control information data (S4).

Next, the printer 1 refers to application amount data of the treatment liquid 201 corresponding to the print speed, the resolution, and the medium type (S5) and determines temperature of the treatment liquid 201 (S6).

Then, the printer 1 calculates the drying strength in the postprocessing drying device 30 (S7).

Next, the feeder 10 conveys the sheet P (S8), the preprocessing device 20 applies the treatment liquid 201 (perform preprocessing) onto the sheet P (S9), and postprocessing drying device 30 dries the treatment liquid 201 on the sheet P (S10). Then, the printing device 50 prints (form an image) on the sheet P (S11), the dryer 70 dries the sheet P (S12), and ejector 90 receives the sheet P conveyed from the dryer 70 and ejected to the ejector 90 (S13).

Next, a temperature control of the treatment liquid 201 according to the first embodiment of the present disclosure is described with reference to FIGS. 7A and 7B to FIG. 9.

Figure 7A:
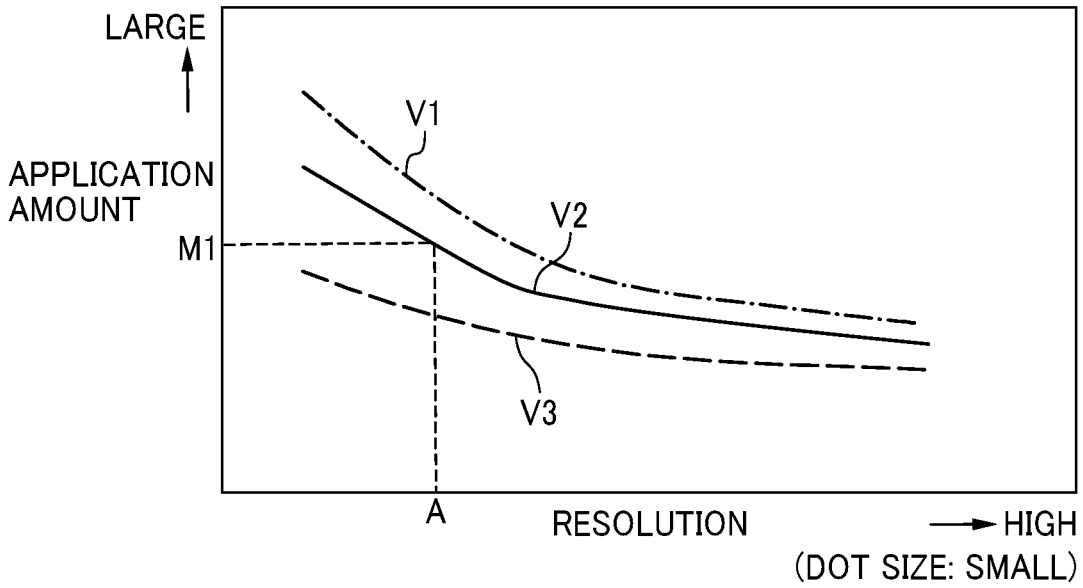
FIGS. 7A and 7B are graphs illustrating an example of a relation between a resolution (print speed) and an application amount of the treatment liquid according to different medium types in the printer according to the first embodiment of the present disclosure.
Figure 7B:
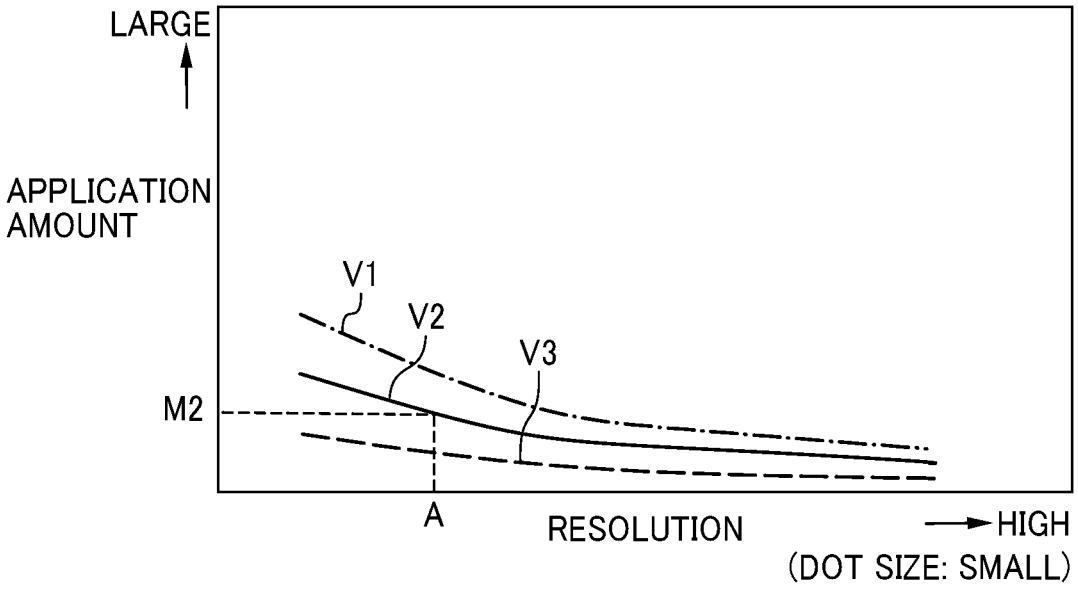

FIGS. 7A and 7B are graphs illustrating an example of a relation between the resolution (print speed) and the application amount of the treatment liquid 201 according to different medium types.

Figure 8:
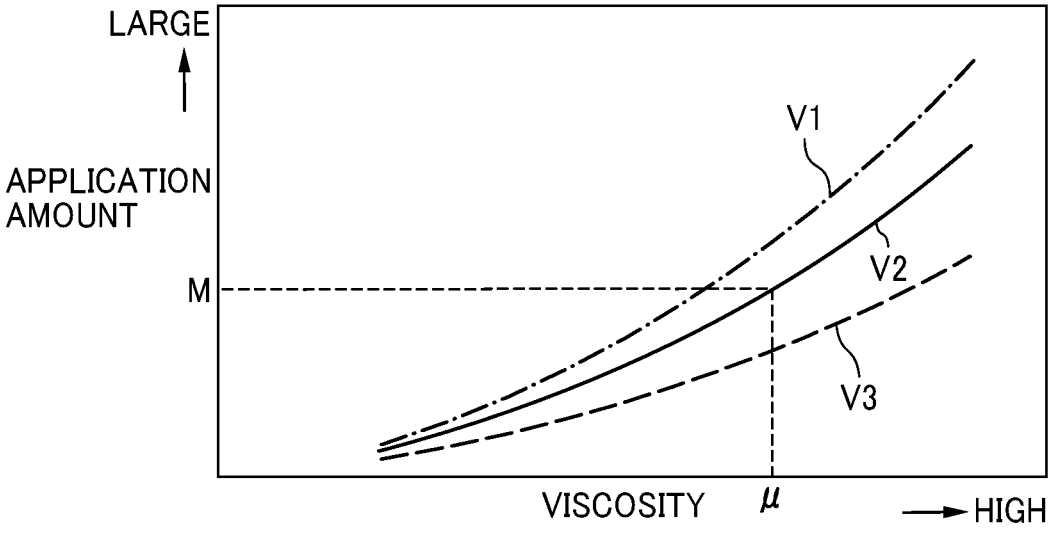
FIG. 8 is a graph illustrating an example of a relation between the viscosity and the application amount of the treatment liquid according to a difference in the print speed in the printer according to the first embodiment of the present disclosure.

FIG. 8 is a graph illustrating an example of a relation between the viscosity of the treatment liquid 201 and the application amount of the treatment liquid 201 according to a difference in the print speed.

Figure 9:
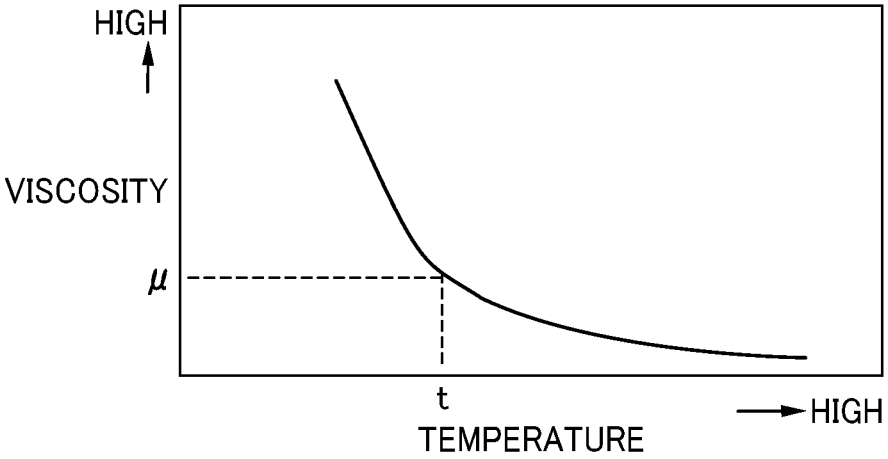
FIG. 9 is a graph illustrating an example of a relationship between the viscosity and the temperature of the treatment liquid in the printer according to the first embodiment of the present disclosure.

FIG. 9 is a graph illustrating an example of a relation between the viscosity of the treatment liquid 201 and the temperature.

The printer 1 according to the first embodiment stores application amount data of the treatment liquid 201 corresponding to the print speed and resolution for each medium type as illustrated in FIGS. 7A and 7B in the storage 702. Here, a print speed V1 is a high speed range, a print speed V2 is a medium speed range, and a print speed V3 is a low speed range.

Thus, a speed range is divided into three stages of a first stage equal to or larger than the print speed V1, a second stage smaller than the print speed V1 and equal to or larger than the print speed V3, and a third stage smaller than the print speed V3. Further, the higher the resolution, the smaller the dot diameter.

FIG. 7A is a graph of the application amount data of the treatment liquid 201 with respect to the print speed and the resolution when the sheet P is a plain paper. FIG. 7A is a graph of the application amount data of the treatment liquid 201 with respect to the print speed and the resolution when the sheet P is a coated paper.

Scales of FIGS. 7A and 7B in a vertical axis and a horizontal axis are matched. FIGS. 7A and 7B illustrate that the application amount M1 and M2 of the treatment liquid 201 corresponds to the same resolution A, and the application amount M1 is larger than the application amount M2.

Here, the application amount of the treatment liquid 201 is set to an application amount at which the bleeding phenomenon or the beading phenomenon does not occur when the resolution is changed at the print speeds V1, V2, and V3. The bleeding phenomenon is a phenomenon in which dots arranged adjacent to each other are mixed. The beading phenomenon is a phenomenon in which a droplet that has landed on the sheet P first is attracted to a droplet that has landed later.

The application amount of the treatment liquid 201 to the sheet P may be in a range larger than the curve illustrated in FIGS. 7A and 7B. However, with increase in the application amount of the treatment liquid 201, the postprocessing drying device 30 has to increase the drying temperature and the drying time. Thus, it is preferable to select the application amount of the treatment liquid 201 as small as possible.

Further, as illustrated in FIG. 8, the storage 702 stores relation data between the application amount M of the treatment liquid 201 and the viscosity of the treatment liquid 201 for each of the print speeds V1, V2, and V3. For example, when the application amount M of the treatment liquid 201 is applied on the sheet P, the viscosity of the treatment liquid 201 is set to a viscosity μ as illustrated in FIG. 8. FIG. 8 illustrates that the application amount M of the treatment liquid 201 increases with an increase in the print speed even with the treatment liquid 201 having the same viscosity.

Further, as illustrated in FIG. 9, the storage 702 stores relation data between the viscosity of the treatment liquid 201 and the temperature of the treatment liquid 201. For example, the temperature controller 701 controls the temperature of the treatment liquid 201 to be the temperature "t" to control the viscosity of the treatment liquid 201 to become "μ."

Therefore, as described above, the user sets the type of the sheet P (medium type) to be used, the printing resolution, and the print speed, and the printer 1 generates control information data from the print image data instructed to print.

Next, the temperature controller 701 of the printer 1 refers to application amount data of the treatment liquid 201 corresponding to the set print speed, the resolution, and the medium type.

First, the temperature controller 701 acquires information on the medium type of the sheet P to be used. Then, the temperature controller 701 selects the application amount data of the treatment liquid 201 illustrated in FIG. 7A or FIG. 7B stored in the storage 702 for the acquired information on the medium type. Then, the temperature controller 701 acquires the application amount M (M1 or M2) corresponding to the set print speed and resolution from the selected application amount data of the treatment liquid 201 illustrated in FIG. 7A or 7B.

For example, when the sheet P is a plain paper, the temperature controller 701 acquires the application amount M1 of the treatment liquid 201 for the print speed V2 and the resolution A from the application amount data of the treatment liquid 201 illustrated in FIG. 7A. On the other hand, when the sheet P is a coated paper, the temperature controller 701 acquires the application amount M2 of the treatment liquid 201 for the print speed V2 and the resolution A from the application amount data of the treatment liquid 201 illustrated in FIG. 7B.

Next, the temperature controller 701 acquires the viscosity of the treatment liquid 201 corresponding to the acquired application amount M of the treatment liquid 201 from information illustrated in FIG. 8. For example, the temperature controller 701 acquires the viscosity μ of the treatment liquid 201 corresponding to the application amount M of the treatment liquid 201.

Therefore, the temperature controller 701 determines (acquires) the temperature t of the treatment liquid 201 corresponding to the acquired viscosity μ of the treatment liquid 201 from FIG. 9. The temperature controller 701 controls the heater 210 as a heater so that the temperature of the treatment liquid 201 in the treatment liquid container 202 becomes the determined temperature t of the treatment liquid 201.

Thus, the temperature controller 701 controls the heater 210 according to the printing conditions and controls the temperature of the treatment liquid 201 to reduce the variation in the application amount of the treatment liquid 201.

Figure 10:
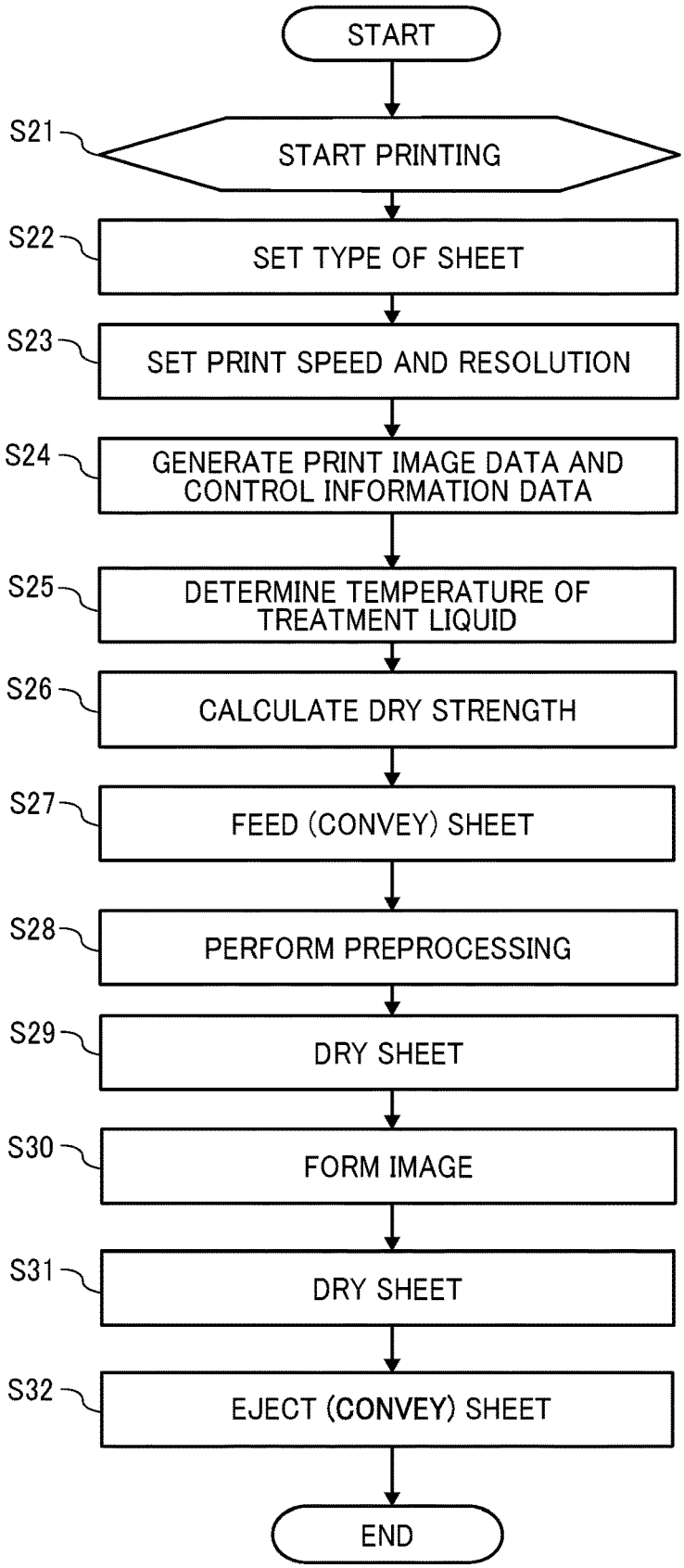
FIG. 10 is a flowchart illustrating control of a printing operation including the temperature control of the treatment liquid of the printer according to a second embodiment of the present disclosure.

Next, the printer 1 according to a second embodiment of the present disclosure is described with reference to FIG. 10. FIG. 10 is a flowchart illustrating control of a printing operation including a temperature control of the treatment liquid 201 of the printer 1 according to the second embodiment of the present disclosure.

When the printer 1 starts to form an image on the sheet P (S21), the printer 1 sets the type of sheet P (S22) and sets the print speed and resolution (step S23).

Then, the printer 1 generates print image data and control information data (S24).

Next, the temperature controller 701 of the printer 1 determines the temperature of the treatment liquid 201 according to at least one of the print speed, the resolution, and the medium type (S25).

Then, the printer 1 calculates the drying strength in the postprocessing drying device 30 (S26).

Next, the feeder 10 feeds (conveys) the sheet P (S27), the preprocessing device applies the treatment liquid 201 (perform preprocessing) onto the sheet P (S28), and postprocessing drying device 30 dries the treatment liquid 201 on the sheet P (S29). Then, the printing device 50 prints (form an image) on the sheet P (S30), the dryer 70 dries the sheet P (S31), and ejector 90 receives the sheet P conveyed from the dryer 70 and ejected to the ejector 90 (S32).

Figure 11:
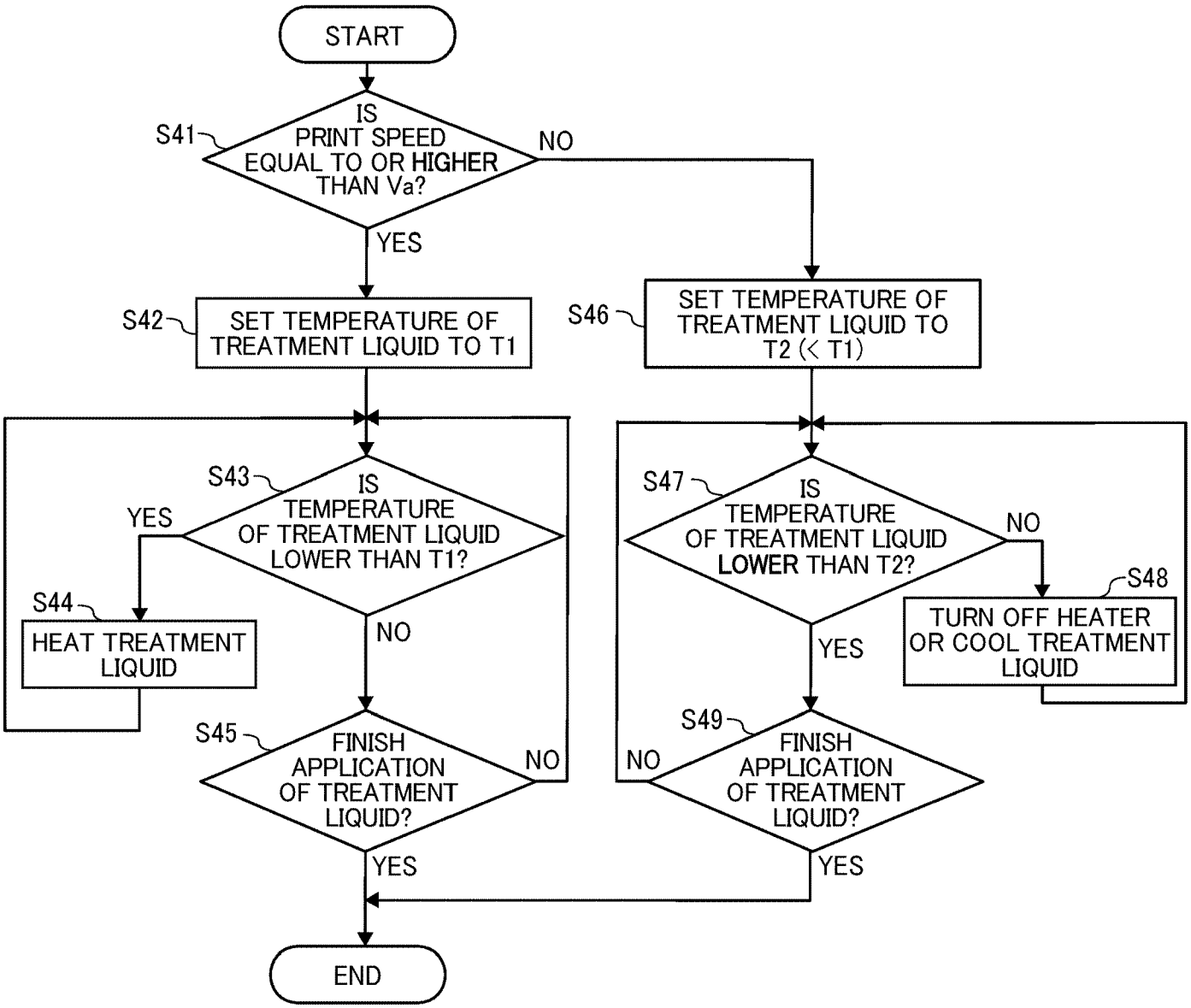
FIG. 11 is a flowchart of the temperature control of the treatment liquid according to the print speed in the printer according to the second embodiment of the present disclosure.

FIG. 11 is a flowchart of the temperature control of the treatment liquid 201 according to the print speed.

First, the printer 1 determines whether the set print speed is equal to or higher than a predetermined speed Va (S41).

If the print speed is equal to or higher than the predetermined speed Va (S41, YES), the temperature controller 701 sets the predetermined temperature T1 as the temperature of the treatment liquid 201 (S42).

Then, the temperature controller 701 determines whether the temperature of the treatment liquid 201 is lower than the predetermined temperature T1 (S43). If the temperature of the treatment liquid 201 is lower than the predetermined temperature T1 (S43, YES), the temperature controller 701 turns on the heater 210 to an ON-state (including duty control) to heat the treatment liquid 201 (S44) in the treatment liquid container 202 (treatment liquid applier 200).

On the other hand, if the temperature of the treatment liquid 201 is not lower than the predetermined temperature T1 (S43, NO), that is, if the temperature of the treatment liquid 201 is equal to or higher than the predetermined temperature T1, the temperature controller 701 determines whether an application of the treatment liquid 201 is finished (S45). The temperature controller 701 returns the process to step S43 until the application of the treatment liquid 201 is finished (completed).

On the other hand, if the print speed is not equal to or higher than the predetermined speed Va (S41, NO), that is, if the print speed is lower than the predetermined speed Va, the temperature controller 701 sets the predetermined temperature T2 as the temperature of the treatment liquid 201 (S46). Here, the predetermined temperature T2 is lower than the predetermined temperature T1 (T2<T1).

Then, the temperature controller 701 determines whether the temperature of the treatment liquid 201 is lower than the predetermined temperature T2 (S47). If the temperature of the treatment liquid 201 is not lower than the predetermined temperature T2 (S47, NO), that is, the temperature of the treatment liquid 201 is equal to or higher than the predetermined temperature T2, the temperature controller 701 turns off the heater 210 and stop heating the treatment liquid 201 (S48).

On the other hand, if the temperature of the treatment liquid 201 is lower than the predetermined temperature T2 (S47, YES), that is, the temperature of the treatment liquid 201 is not equal to or higher than the predetermined temperature T2, the temperature controller 701 determines whether the application of the treatment liquid 201 is completed (S49). The temperature controller 701 returns the process to step S47 until the application of the treatment liquid 201 is completed.

In any case, the above-described temperature control of the treatment liquid 201 is terminated when the application of the treatment liquid 201 is completed.

As described above, if the print speed is equal to or higher than the predetermined speed Va, the temperature controller 701 controls the heater 210 to increase the temperature of the treatment liquid 201 such that the temperature of the treatment liquid 201, when the print speed is equal to or higher than the predetermined speed Va, is higher than the temperature of the treatment liquid 201 when the print speed is lower than the predetermined speed Va.

Figure 12:
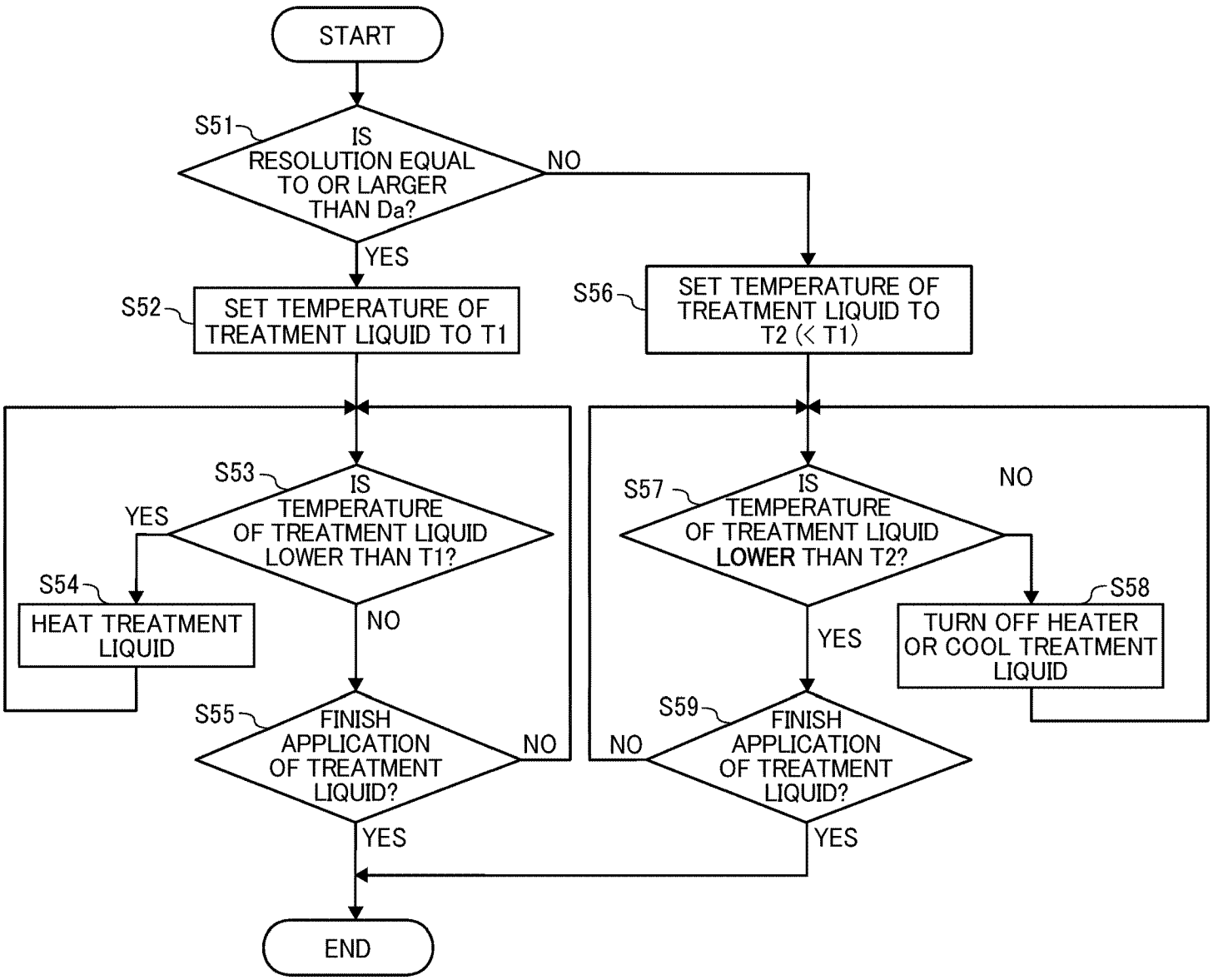
FIG. 12 is a flowchart of the temperature control of the treatment liquid according to the resolution in the printer according to the first embodiment of the present disclosure.

FIG. 12 is a flowchart of the temperature control of the treatment liquid 201 according to the resolution.

First, the printer 1 determines whether the set resolution is equal to or higher than a predetermined resolution Da (S51).

If the resolution is equal to or higher than the predetermined resolution Da, the temperature controller 701 sets the predetermined temperature T1 as the temperature of the treatment liquid 201 (S52).

Then, the temperature controller 701 determines whether the temperature of the treatment liquid 201 is lower than the predetermined temperature T1 (S53). If the temperature of the treatment liquid 201 is lower than the predetermined temperature T1 (S53, YES), the temperature controller 701 turns on the heater 210 to an ON-state (including duty control) to heat the treatment liquid 201 (S54) in the treatment liquid container 202 (treatment liquid applier 200).

On the other hand, if the temperature of the treatment liquid 201 is not lower than the predetermined temperature T1 (S53, NO), that is, if the temperature of the treatment liquid 201 is equal to or higher than the predetermined temperature T1, the temperature controller 701 determines whether an application of the treatment liquid 201 is completed (S55). The temperature controller 701 returns the process to step S53 until the application of the treatment liquid 201 is finished (completed).

On the other hand, if the resolution is not equal to or higher than the predetermined resolution Da, that is, if the resolution is lower than the predetermined resolution Da, the temperature controller 701 sets the predetermined temperature T2 as the temperature of the treatment liquid 201 (S56). Here, the predetermined temperature T2 is lower than the predetermined temperature T1 (T2<T1).

Then, the temperature controller 701 determines whether the temperature of the treatment liquid 201 is lower than the predetermined temperature T2 (S57), that is, the temperature of the treatment liquid is equal to or higher than the predetermined temperature T2. If the temperature of the treatment liquid 201 is not lower than the predetermined temperature (S57, NO), that is, the temperature of the treatment liquid 201 is equal to or higher than the predetermined temperature T2, the temperature controller 701 turns off the heater 210 and stop heating the treatment liquid 201 (S58).

On the other hand, if the temperature of the treatment liquid 201 is lower than the predetermined temperature (S57, YES), that is, the temperature of the treatment liquid 201 is not equal to or higher than the predetermined temperature T2, the temperature controller 701 determines whether the application of the treatment liquid 201 is finished (S59). The temperature controller 701 returns the process to step S57 until the application of the treatment liquid 201 is finished (completed).

In any case, the above-described temperature control of the treatment liquid 201 is terminated when the application of the treatment liquid 201 is completed.

As described above, if the resolution is equal to or higher than the predetermined resolution Da, the temperature controller 701 controls the heater 210 to increase the temperature of the treatment liquid 201 such that the temperature of the treatment liquid 201, when the resolution is equal to or higher than the predetermined resolution Da, is higher than the temperature of the treatment liquid 201 when the resolution is lower than the predetermined resolution Da.

Figure 13:
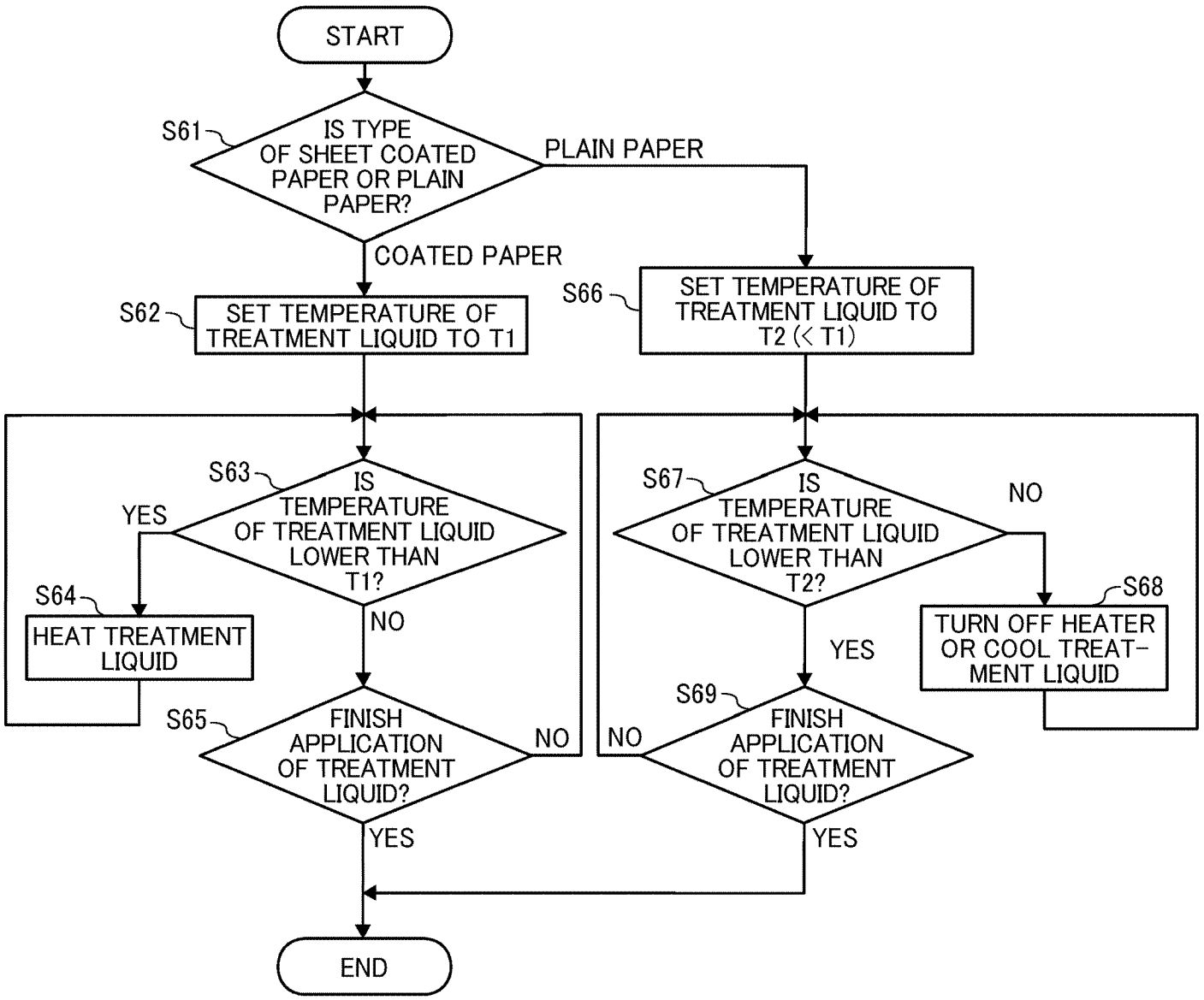
FIG. 13 is a flowchart of the temperature control of the treatment liquid according to a type of a sheet (medium type) in the printer according to the first embodiment of the present disclosure.

FIG. 13 is a flowchart of the temperature control of the treatment liquid 201 according to the medium type.

First, the printer 1 determines whether the set type of the sheet P (medium type) is a coated paper (S61).

If the sheet P is a coated paper, the temperature controller 701 sets the predetermined temperature T1 as the temperature of the treatment liquid 201 (S62).

Then, the temperature controller 701 determines whether the temperature of the treatment liquid 201 is lower than the predetermined temperature T1 (S63). If the temperature of the treatment liquid 201 is lower than the predetermined temperature T1 (S63, YES), the temperature controller 701 turns on the heater 210 to an ON-state (including duty control) to heat the treatment liquid 201 (S64) in the treatment liquid container 202 (treatment liquid applier 200).

On the other hand, if the temperature of the treatment liquid 201 is not lower than the predetermined temperature T1 (S63, NO), that is, if the temperature of the treatment liquid 201 is equal to or higher than the predetermined temperature T1, the temperature controller 701 determines whether an application of the treatment liquid 201 is finished (S65). The temperature controller 701 returns the process to step S63 until the application of the treatment liquid 201 is finished (completed).

On the other hand, if the sheet P is not a coated paper, that is, if the sheet P is a plain paper, the temperature controller 701 sets the predetermined temperature T2 as the temperature of the treatment liquid 201 (S66). Here, the predetermined temperature T2 is lower than the predetermined temperature T1 (T2<T1).

Then, the temperature controller 701 determines whether the temperature of the treatment liquid 201 is lower than the predetermined temperature T2 (S67). If the temperature of the treatment liquid 201 is not lower than the predetermined temperature T2 (S67, NO), that is, the temperature of the treatment liquid 201 is equal to or higher than the predetermined temperature T2, the temperature controller 701 turns off the heater 210 and stop heating the treatment liquid 201 (S68).

On the other hand, if the temperature of the treatment liquid 201 is lower than the predetermined temperature (S67, YES), that is, the temperature of the treatment liquid 201 is equal to or higher than the predetermined temperature T2, the temperature controller 701 determines whether the application of the treatment liquid 201 is finished (S69). The temperature controller 701 returns the process to step S67 until the application of the treatment liquid 201 is finished (completed).

In any case, the above-described temperature control of the treatment liquid 201 is terminated when the application of the treatment liquid 201 is completed.

As described above, if the sheet P is a coated paper, the temperature controller 701 controls the heater 210 to increase the temperature of the treatment liquid 201 such that the temperature of the treatment liquid 201 when the sheet P is a coated paper is higher than the temperature of the treatment liquid 201 when the sheet P is a plain paper.

Figure 14:
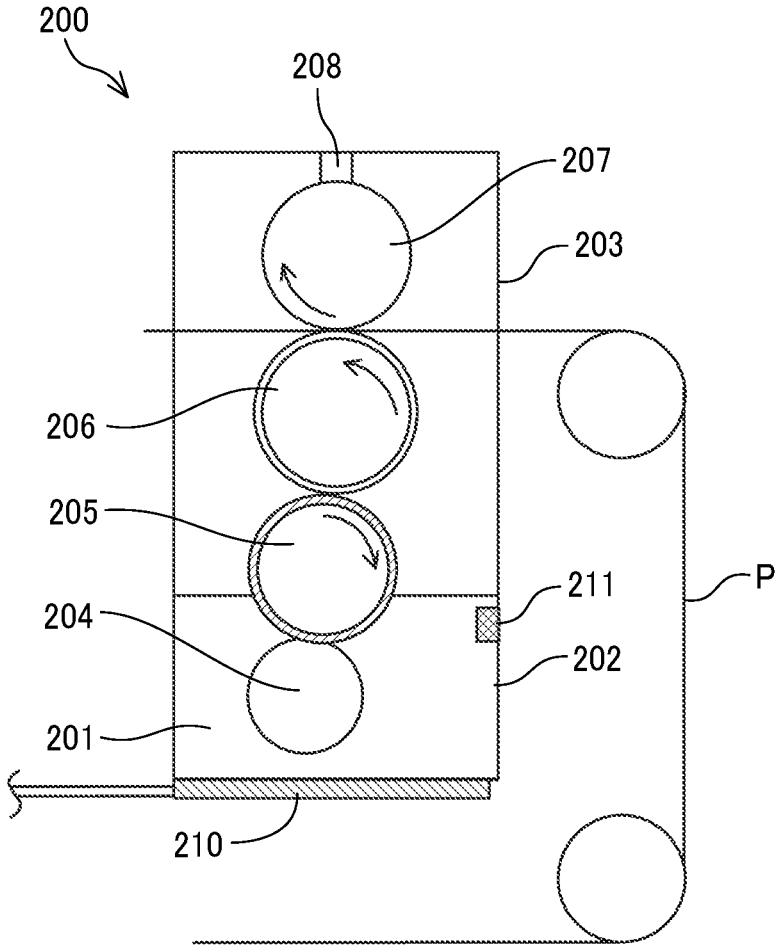
FIG. 14 is a cross-sectional front view of the treatment liquid applier according to a third embodiment of the present disclosure.

Next, the printer 1 according to a third embodiment of the present disclosure is described with reference to FIG. 14. FIG. 14 is a cross-sectional front view of the treatment liquid applier 200 according to the third embodiment of the present disclosure.

The treatment liquid applier 200 according to the third embodiment is different from the treatment liquid applier 200 according to the first embodiment. For example, the transfer roller 205 is a heating roller so that the transfer roller 205 is also used as a heater. The treatment liquid applier 200 may include the heater 210 together with the transfer roller 205 as the heater. However, the treatment liquid applier 200 not necessarily includes the heater 210.

Figure 15:
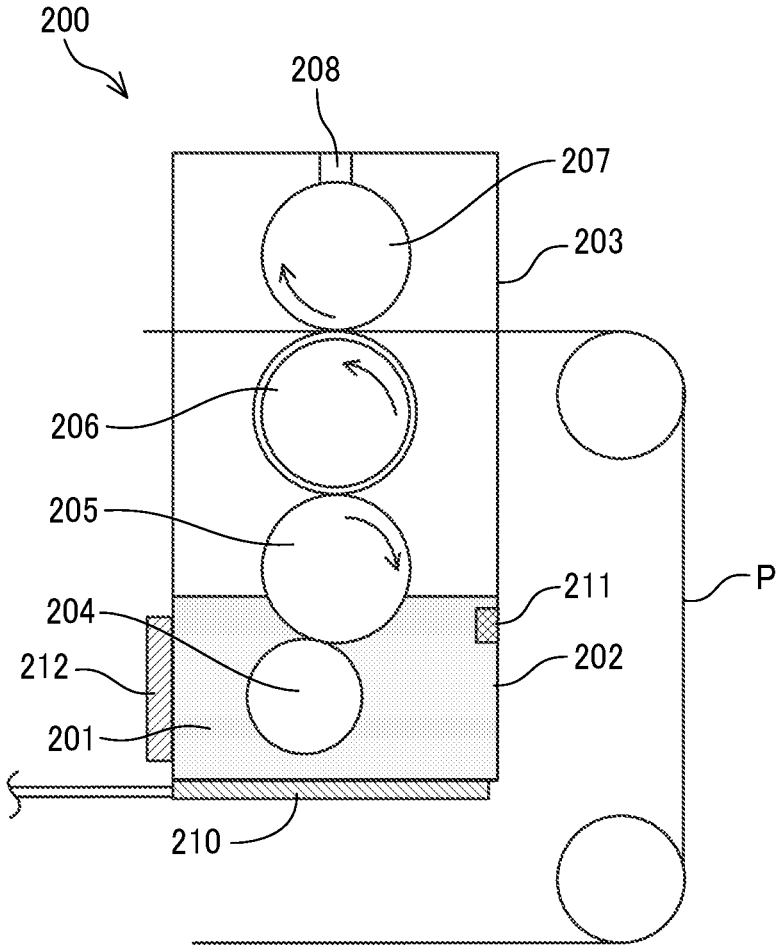
FIG. 15 is a cross-sectional front view of the treatment liquid applier according to a fourth embodiment of the present disclosure.

Next, the treatment liquid applier 200 according to a fourth embodiment of the present disclosure is described with reference to FIG. 15. FIG. 15 is a cross-sectional front view of the treatment liquid applier 200 according to the fourth embodiment of the present disclosure.

The treatment liquid applier 200 according to the fourth embodiment includes a cooler 212 to cool the treatment liquid 201 in addition to a configuration in the treatment liquid applier 200 according to the first embodiment.

The treatment liquid applier 200 may use one type of the cooler 212 that includes a channel inside a plate. The plate contacts the treatment liquid container 202. A cooling medium passes through the channel in the plate. The plate includes a fan to cool the cooling medium passing through the channel in the plate. Further, the cooler 212 may include a heat dissipation fin on a plate to dissipate the heat taken by the plate via the heat dissipation fin.

Thus, the treatment liquid applier 200 can control the application amount of the treatment liquid 201 having various viscosity characteristics. Thus, the printer 1 can control the temperature of the treatment liquid 201 to a temperature lower than an environmental temperature.

In the above-described embodiment, the print speed is divided into two categories (whether the speed is equal to or higher than a predetermined rate) or three categories (fast, medium, slow). However, the print speed may also be divided into four or more categories, and the treatment liquid applier 200 controls the temperature of the treatment liquid 201 corresponding to the print speed. Similarly, the resolution and the type of the sheet P may also be divided into three categories or three or more types, and treatment liquid applier 200 controls the temperature of the treatment liquid 201 corresponding to the categories of the resolution and the type of the sheet (medium type).

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions. For example, the temperature controller 701 as described above may be implemented by one or more processing circuits or circuitry.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways.

Such variations are not to be regarded as a departure from the scope of the present disclosure and appended claims, and all such modifications are intended to be included within the scope of the present disclosure and appended claims.

What is claimed is:

1. A printer comprising:

a treatment liquid applier configured to apply a treatment liquid onto a sheet;

a printing device configured to print on the sheet onto which the treatment liquid has been applied;

a heater configured to heat the treatment liquid in the treatment liquid applier; and circuitry configured to:

control the heater according to a printing condition to print on the sheet; and control the heater to increase a temperature of the treatment liquid, when a print speed as the printing condition is equal to or higher than a predetermined speed, to be higher than the temperature of the treatment liquid when the print speed is lower than the predetermined speed.

2. A printer comprising:

a treatment liquid applier configured to apply a treatment liquid onto a sheet;

a printing device configured to print on the sheet onto which the treatment liquid has been applied;

a heater configured to heat the treatment liquid in the treatment liquid applier; and circuitry configured to:

control the heater according to a printing condition to print on the sheet; and control the heater to increase a temperature of the treatment liquid, when a resolution as the printing condition is equal to or higher than a predetermined resolution, to be higher than the temperature of the treatment liquid when the resolution is lower than the predetermined resolution.

3. The printer according to claim 1, wherein the circuitry is further configured to:

control the heater to increase a temperature of the treatment liquid, when a type of the sheet as the printing condition is a coated paper, to be higher than a temperature of the treatment liquid when the type of the sheet is a plain paper.

4. The printer according to claim 1, wherein the circuitry is further configured to:

acquire an application amount of the treatment liquid to be applied onto the sheet, the application amount corresponding to the print speed and a resolution as the printing condition;

acquire a viscosity of the treatment liquid corresponding to the application amount acquired;

acquire a temperature of the treatment liquid in the treatment liquid applier corresponding to the viscosity acquired; and control the heater to heat the treatment liquid in the treatment liquid applier to the temperature determined.

5. A printer comprising:

a treatment liquid applier configured to apply a treatment liquid onto a sheet a printing device configured to print on the sheet onto which the treatment liquid has been applied;

a heater configured to heat the treatment liquid in the treatment liquid applier;

circuitry configured to control the heater according to a printing condition to print on the sheet; and the printer further comprising:

a cooler configured to cool the treatment liquid, wherein the circuitry is further configured to control the cooler to cool the treatment liquid.

* * * * *